United States Patent [19]

Pfleger

[11] 4,236,881

[45] Dec. 2, 1980

[54] LIQUID METERING PUMP

[75] Inventor: Robert K. Pfleger, Forest Lake, Minn.

[73] Assignee: Ecodyne Corporation, Lincolnshire, Ill.

[21] Appl. No.: 902,513

[22] Filed: May 3, 1978

[51] Int. Cl.[3] ..... F04B 7/00

[52] U.S. Cl. ..... 417/502; 417/506; 417/510

[58] Field of Search ..... 417/506, 502, 510

[56] References Cited

U.S. PATENT DOCUMENTS

| | | | |
|---|---|---|---|
| 1,897,179 | 2/1933 | Ricardo | 417/510 X |
| 1,952,159 | 3/1934 | Atteslander | 417/502 X |
| 2,308,974 | 1/1943 | Harper | 417/510 |
| 2,997,956 | 8/1961 | Stewart | 417/502 X |
| 3,829,242 | 8/1974 | Duke et al. | 417/38 |

FOREIGN PATENT DOCUMENTS

| | | | |
|---|---|---|---|
| 497480 | 5/1930 | Fed. Rep. of Germany | 417/502 |
| 289677 | 10/1931 | Italy | 417/510 |

*Primary Examiner*—Richard E. Gluck

*Attorney, Agent, or Firm*—Charles M. Kaplan; Joel E. Siegel

[57] ABSTRACT

A liquid metering pump has power-operated poppet valves in its intake and return conduits. The quantity of liquid discharged is controlled by a movable cam which determines how long the liquid return conduit is open. A switch operated by a portion of a pumping diaphragm prevents excess pressure from damaging the pump.

22 Claims, 31 Drawing Figures

Fig. 17.
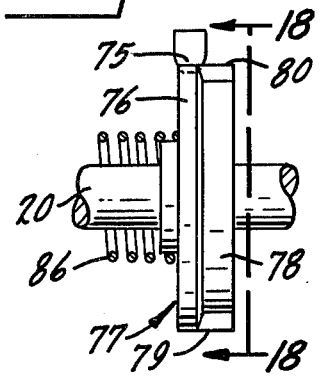
Fig. 18.
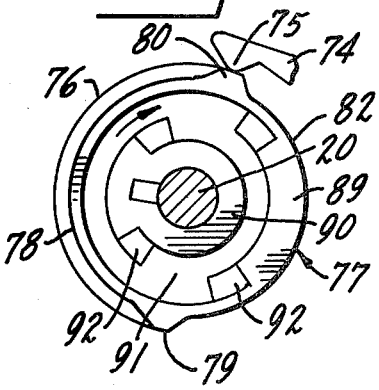
Fig. 19.
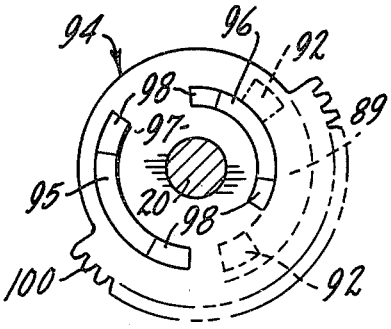
Fig. 20.
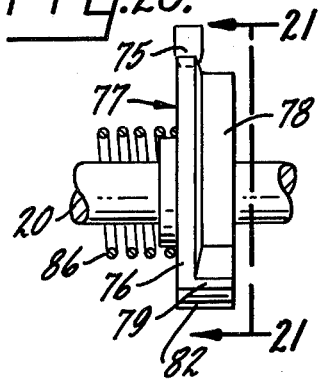
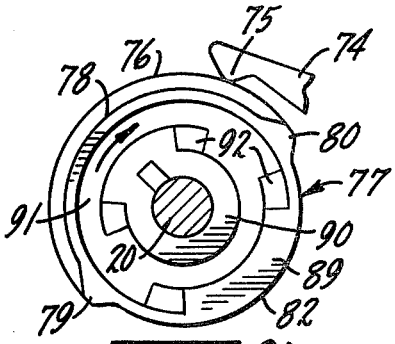
Fig. 21.
Fig. 22.
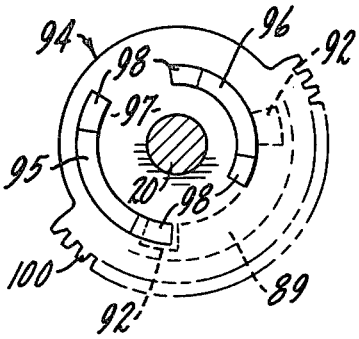
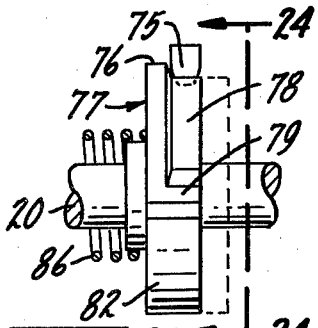
Fig. 23.
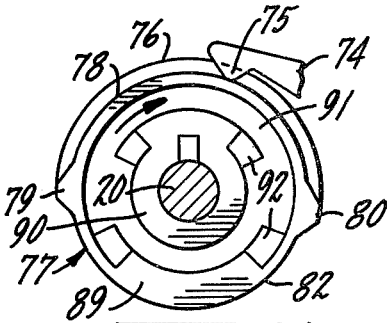
Fig. 24.
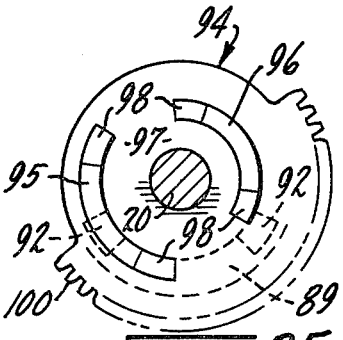
Fig. 25.
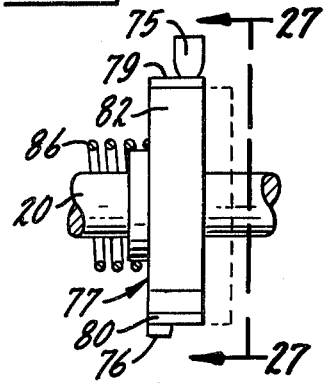
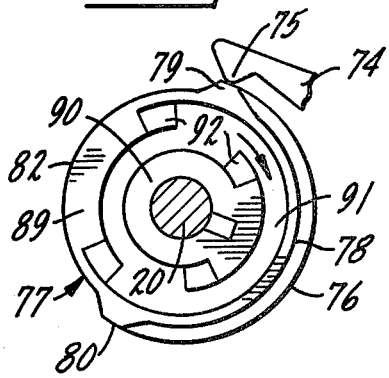
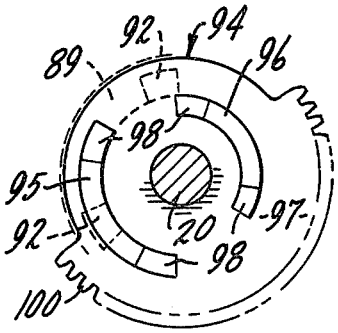
Fig. 26.
Fig. 27.
Fig. 28.

LIQUID METERING PUMP

BACKGROUND OF THE INVENTION

This invention relates to the positive displacement pumping of liquids, and more particularly to methods and apparatus for metering relatively small quantities of liquid, such as when a chemical solution is fed from a supply container into a large body or stream of liquid which may or may not be pressurized.

Small metering pumps have used spring biased check valves to control liquid intake and recirculation flow. The springs had to be located in liquid flow conduits, which caused them to corrode, or contaminate the liquid, or otherwise malfunction. Such springs and the outlet check valve spring had to be relatively weak (e.g., 2 oz.) in order to permit priming, suction lift and degassing of the pump to occur against the lightly biased check valves. When the pump was used to meter solutions containing foreign matter or chemicals which build up on or around the check valves, the valves would soon cease to operate. Also, the quantity of liquid dispensed by such pumps could not always be accurately controlled as the springs or valve sealing surfaces deteriorated. Sometimes a chemical solution being pumped would form a precipitate that would cause a blockage downstream from the pump, and continued operation of the pump would cause internal pressure to build up until the pump or its motor were damaged.

OBJECTIVES OF THE INVENTION

Accordingly, it is an object of this invention to provide improved methods and apparatus for metering controllable quantities of liquid.

Another object is to meter liquids without using lightly biased spring check valves and without locating springs in liquid intake and return flow conduits.

Another object is to provide a metering pump with power driven poppet valves that are forced by strong springs to seal against surfaces which may be impaired by foreign matter or chemicals precipitated from the liquid being pumped.

Another object is to provide a chemical metering pump that does not require a manual or external mechanism to relieve discharge pressure in order for the pump to prime.

Another object is to provide a pump which automatically prevents the accumulation of gas in the pump head.

Another object is to provide a liquid metering pump with a check valve in its discharge outlet that is closed by a strong spring.

Another object is to provide a pump which need not be removed from service to degas.

Another object is to provide a liquid metering pump having power driven valves which do not have to open against discharge back pressure.

Another object is to provide methods and apparatus which combine the way in which gas or gas pressure is removed from a pump with the control for regulating the quantity of liquid discharged by the pump.

Another object is to control the quantity of liquid metered by a pump without changing the pumping mechanism stroke frequency or length.

Another object is to provide a variable output liquid metering pump with a control that shuts off the pump if its internal pressure exceeds a predetermined safe limit.

Another object is to provide a self-priming, self-degassing pump capable of metering very small controllable quantities of chemical solutions which can cause precipitates to form in the pump.

Another object is to provide a compact, durable, relatively inexpensive and easily maintained chemical solution metering pump that does not possess defects found in comparable prior art devices.

Other objects and advantages of the invention will be found in the specification and claims, and the scope of the invention will be set forth in the claims.

DESCRIPTION OF THE DRAWINGS

FIG. 17 is an end view of the return valve actuating cam and follower during the degassing phase at the beginning of the pressure stroke.

FIG. 18 is a side view taken along the line 18—18 in FIG. 17.

FIG. 19 is a side view of the flow control cam showing in phantom the position of a projection from the cam in FIGS. 17 and 18.

FIG. 20 is an end view of the return valve actuating cam and follower during the liquid return phase of the pressure stroke.

FIG. 21 is a side view taken along the line 21—21 in FIG. 20.

FIG. 22 is a side view of the flow control cam showing in phantom the position of a projection from the cam in FIGS. 20 and 21.

FIG. 23 is an end view of the return valve actuating cam and follower during the liquid discharge phase of the pressure stroke.

FIG. 24 is a side view taken along the line 24—24 in FIG. 23.

FIG. 25 is a side view of the flow control cam showing in phantom the position of a projection from the cam in FIGS. 23 and 24.

FIG. 26 is an end view of the return valve actuating cam and follower during the degassing phase at the end of the pumping stroke.

FIG. 27 is a side view taken along the line 27—27 in FIG. 26.

FIG. 28 is a side view of the flow control cam showing in phantom the position of a projection from the cam in FIGS. 26 and 27.

DESCRIPTION OF THE INVENTION

Figure 1:
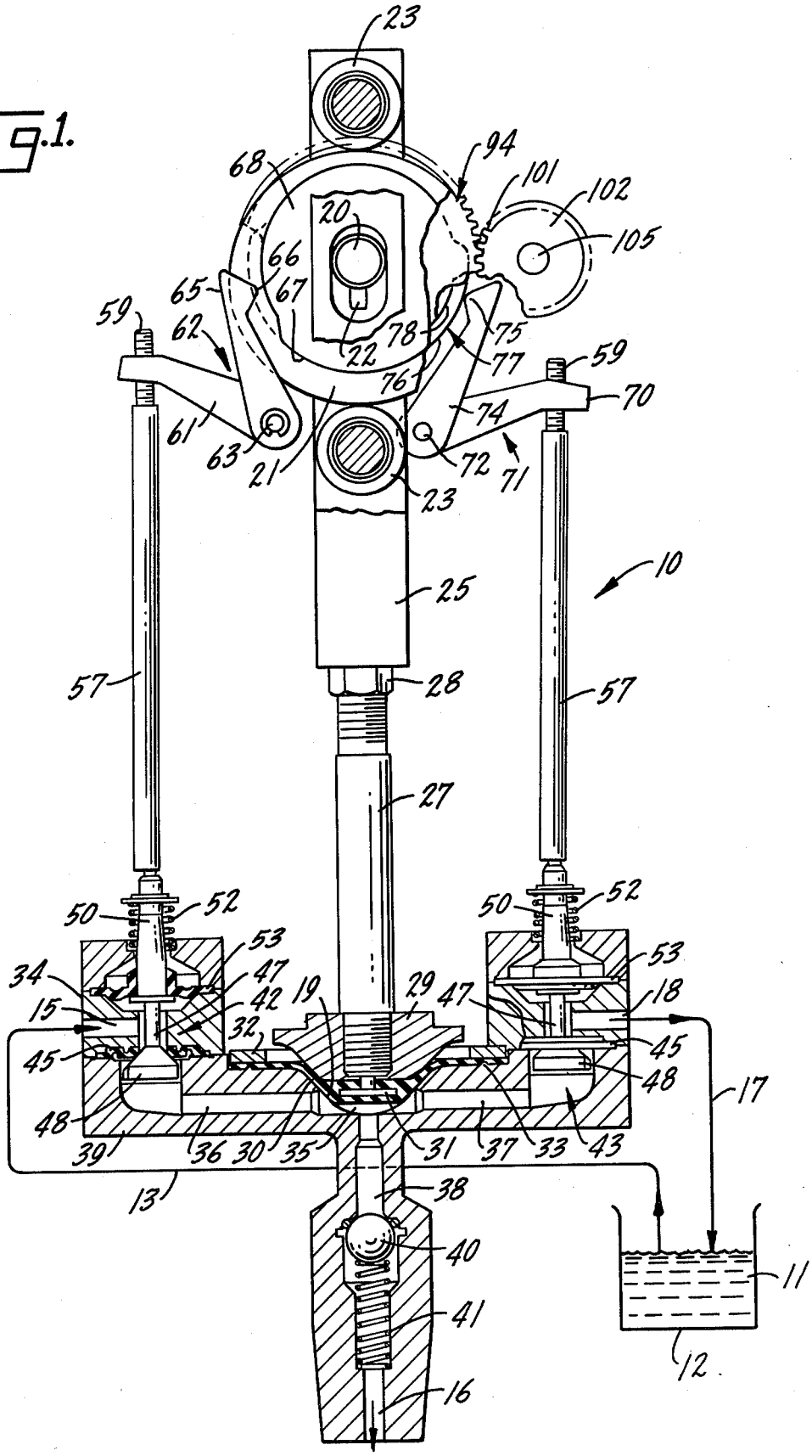
FIG. 1 is a schematic, partially cross-sectional, partially broken-away view illustrating the manner of operation of the pump shown herein.
Figures 2, 10, 11, 12, 14, 15, 16:
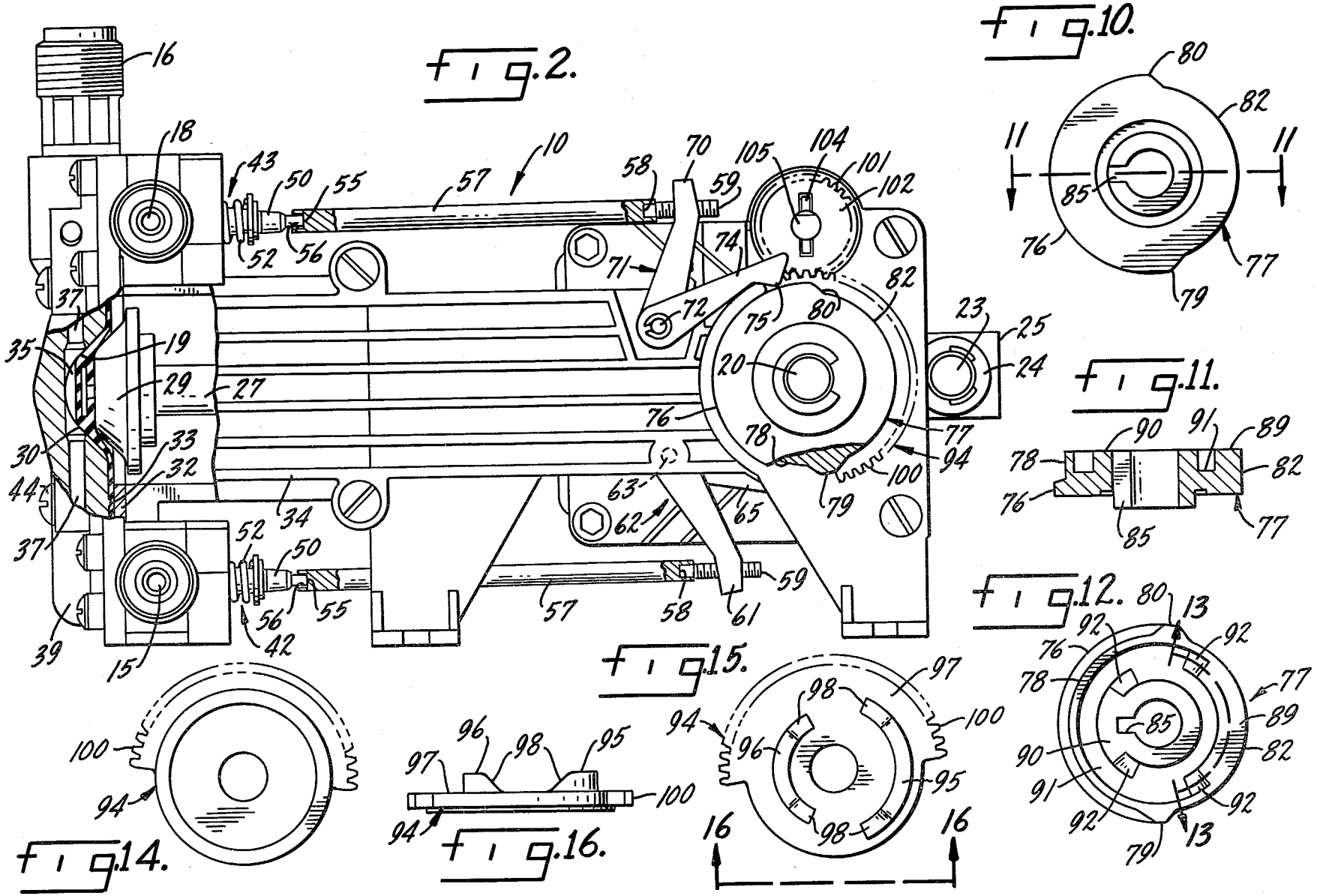
FIG. 2 is a partially broken-away side view of a metering pump in accord with this invention.
FIG. 10 is a side view of the liquid return valve actuating cam.
FIG. 11 is a cross-sectional view taken along the line 11—11 in FIG. 10.
FIG. 12 is a view of the opposite side of the cam in FIG. 10.
FIG. 14 is a side view of the flow control cam.
FIG. 15 is a view of the opposite side of the cam in FIG. 14.
FIG. 16 is an end view taken along the line 16—16 in FIG. 15.

The drawing shows a pump 10 for metering small, variably controllable quantities of a chemical solution 11, such as sodium hypochlorite. The solution 11 may flow from a conventional source such as container 12 through a supply line or conduit 13 to a liquid inlet port 15 of pump 10. A predetermined quantity of the solution is metered from pump 10 through a liquid discharge port 16. A predetermined quantity of the solution may be recirculated to container 12 through a suitable line or conduit 17 connected to a liquid return port 18, which is located near the top of pump 10 to facilitate escape of gas that may be trapped therein.

Pump 10 is powered by a shaft 20 driven by a conventional electric motor and gear box (not shown) so as to rotate at a constant speed. A drive cam 21 is keyed to shaft 20 by pins 22. A pair of identical rotatable roller bearings 23 are held by spring clips 24 in a yoke 25 and sandwich cam 21 therebetween. Rotation of cam 21 by shaft 20 against bearings 23 causes yoke 25 to reciprocate back and forth a predetermined distance. A threaded shaft 27 is attached at one end to yoke 25 by nuts 28. At its other end, shaft 27 is threaded into a tapered cap 29. A reciprocating member comprising a circular, flexible diaphragm 30 is secured to cap 29 by a disc 31 imbedded in diaphragm 30 and integral with cap 29.

Pump 10 has a plastic body including a housing 34 with a removable head or end cap 39 attached by screws 44 threaded into tapped holes. Suitable gasket means 32 contacting a side of diaphragm 30 seals the opposed surfaces of end cap 39 and housing 34. Beads 33 on cap 39 hold diaphragm 30 in place. Ports 15 and 18 are in housing 34 and port 16 is in end cap 39. A surface 19 of cap 39 defines a pump chamber 35 in which diaphragm 30 reciprocates. In cap 39 a liquid inlet passage or conduit 36 connects chamber 35 to port 15, a liquid return passage or conduit 37 connects chamber 35 to port 18, and a liquid discharge passage or conduit 38 connects chamber 35 to port 16. Movement of diaphragm 30 in one direction (e.g., upwardly in FIG. 1) creates a suction for drawing the solution from container 12 through conduit 36 into chamber 35, and movement of diaphragm 30 in the opposite direction creates the pressure for pumping the solution out of chamber 35 through passages 37 and 38.

Thus diaphragm 30 defines a reciprocating surface of chamber 35. Outlet passage 38 is closed by a spherical ball check valve 40 urged against its seal by a coil spring 41 which is strong enough (e.g., 1.1 to 2.2 lbs.) to ensure the sealing of valve 40; thus liquid can be discharged through port 16 only after the back pressure (e.g., 15 p.s.i.) of spring 41 is overcome.

Figure 9:
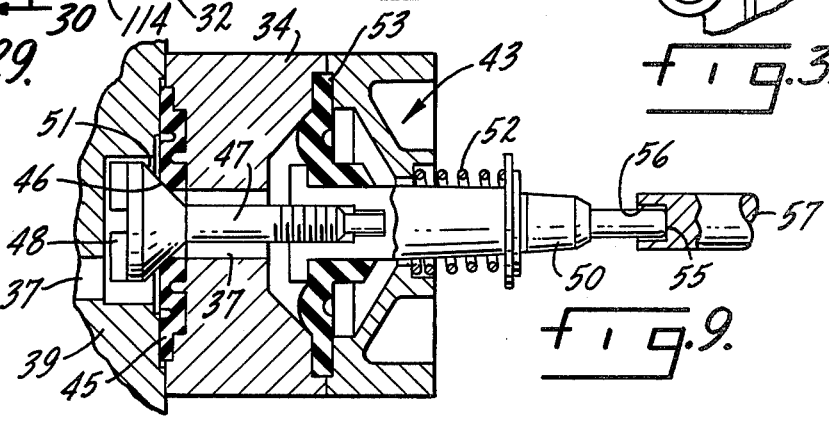
FIG. 9 is an enlarged cross-sectional view taken along the line 9—9 in FIG. 5.

A first reciprocating power driven poppet valve 42 controls liquid flow through inlet passage 36, and a second reciprocating power driven poppet valve 43 controls liquid flow through return passage 37. Valves 42 and 43 are identical, so only the construction of valve 43 is shown in detail (in FIG. 9), and the same reference numbers are used for corresponding parts. A resilient valve seat 45 has a conical sealing surface 46 defining a hole surrounding conduit 37, and the stem 47 of a valve closure member 48 extends through such hole and is threaded into the end of a stem 50. Conical surface 51 on member 48 mates with surface 46, and a strong coil spring 52 around stem 50 urges member 48 to its closed position. Spring 52 seats member 48 with sufficient force (e.g., 2.2 lbs.) to ensure that valve 43 will be closed despite foreign matter or precipitated chemicals on the mating surfaces. A movable gasket 53 seals conduit 36 around stem 50 and isolates spring 52 from the liquid being metered. The terminal end 55 of each stem 50 is received in an opening 56 in one end of an actuating rod 57. The opposite end of each rod 57 has an opening 58 which receives an end of a threaded rod 59.

The rod 59 connected to inlet valve 42 is threaded into an actuating arm 61 of a lever 62 pivoted on an axis 63. A cam follower arm 65 of lever 62 has a lug 66 for riding on the protruding cam surface 67 at the circumferential edge of an inlet valve actuating cam 68 which is integral and coaxial with drive cam 21. Rotation of shaft 20 moves cam surface 67 into contact with lug 66; this pivots lever 62 so as to move actuating rod 57 in the direction which compresses spring 52 and moves valve member 48 out of sealing engagement with its seat. This opens inlet passage 36 and permits liquid from container 11 to be drawn into chamber 35. Cams 21 and 68 are related such that cam surface 67 pushes valve 42 open just as cam 21 begins the suction stroke in which diaphragm 30 moves in the direction which creates suction in chamber 35, and surface 67 moves out of contact with lug 66 and permits spring 52 to close valve 42 just as cam 21 is about to move diaphragm 30 in the opposite direction during the pressure or discharge stroke, which causes liquid to be expelled from chamber 35.

The rod 59 connected to liquid return valve 43 is threaded into an actuating arm 70 of a lever 71 pivoted on an axis 72. A cam follower arm 74 of lever 71 has a lug 75 for riding on the protruding cam surface 76 at the circumferential edge of a liquid return valve actuating cam 77. When rotation of shaft 20 moves surface 76 into contact with lug 75, lever 71 pivots so as to move actuating rod 57 in the direction which compresses spring 52 and opens valve 43. This opens return passage 37 and causes liquid to be pumped through conduit 17 back into container 12 and also allows gas trapped in the pump to escape to the atmosphere.

Cam surface 76 extends only partially around cam 77 in the circumferential direction. Cam surface 76 extends only partially across cam 77 in the direction of its axis of rotation, and thereby defines a gulley 78 on one side of the cam. A pair of cam lobes 79 and 80 extend all the way across the peripheral edge of cam 77 at the ends of surface 76 and thus define the ends of gulley 78. The remaining circumferential surface 82 of cam 77 has the same radius as the bottom of gulley 78. Cam 77 is coaxial with cams 21 and 68 and is keyed on shaft 20 by pins 84 received in a slot 85. Cam 77 is slidable longitudinally along shaft 20 against the bias of spring 86 which is coiled around shaft 20. A first pair of projections 89 and 90 shaped like circular arcs extend from the flat surface 91 of cam 77 in a plane perpendicular to cam surface or edge 76. Ramps 92 merge each end of each of the projections 89 and 90 into flat surface 91.

Figures 3, 7, 8, 13:
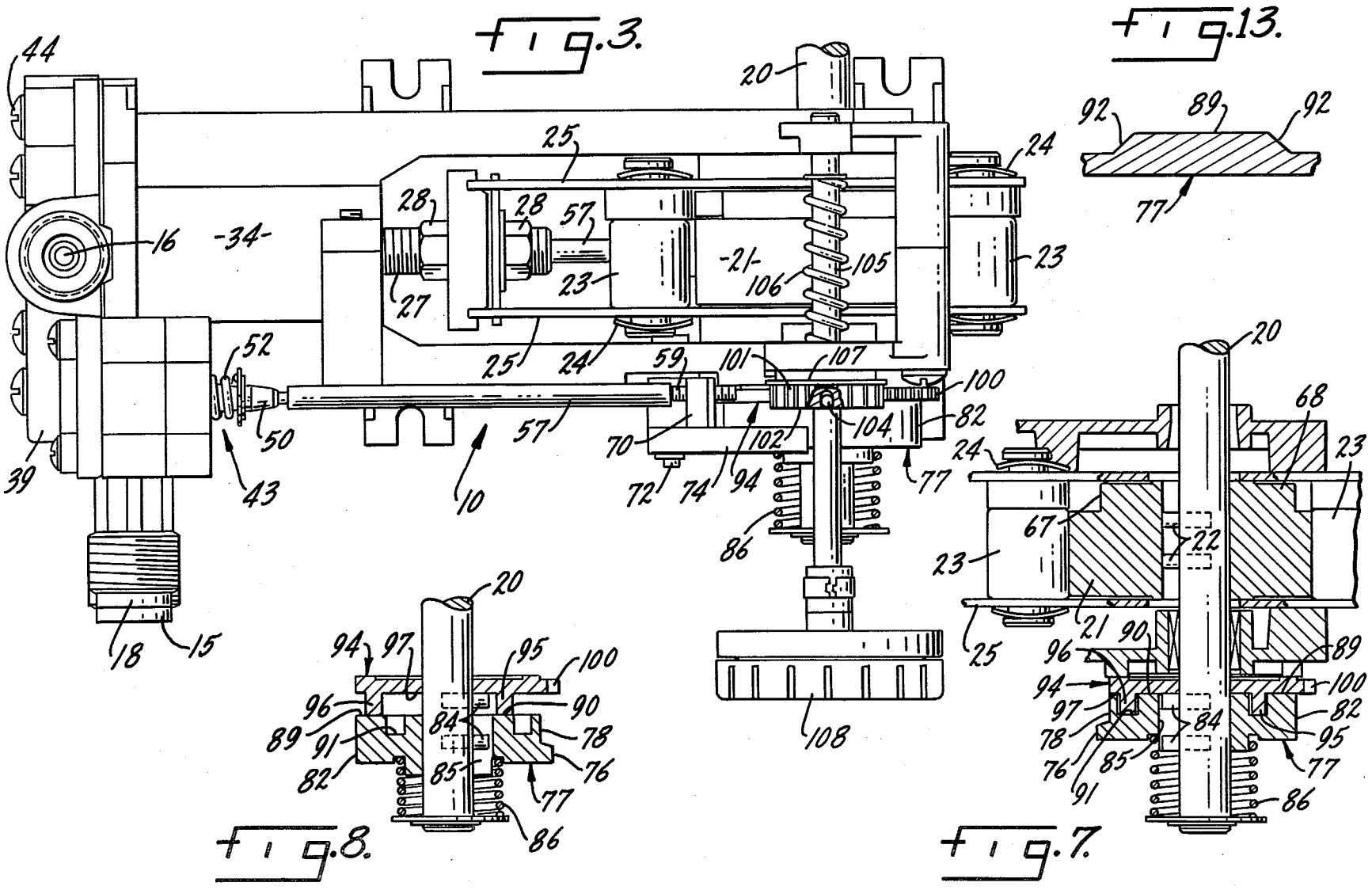
FIG. 3 is a partially cross-sectional top view of the pump in FIG. 2.
FIG. 7 is an enlarged cross-sectional view showing the power shaft for the pump shown herein.
FIG. 8 is a cross-sectional view corresponding to FIG. 7 showing the liquid return valve actuating cam hifted along the power shaft.
FIG. 13 is a cross-sectional view taken along the line 13—13 in FIG. 12.
Figure 4:
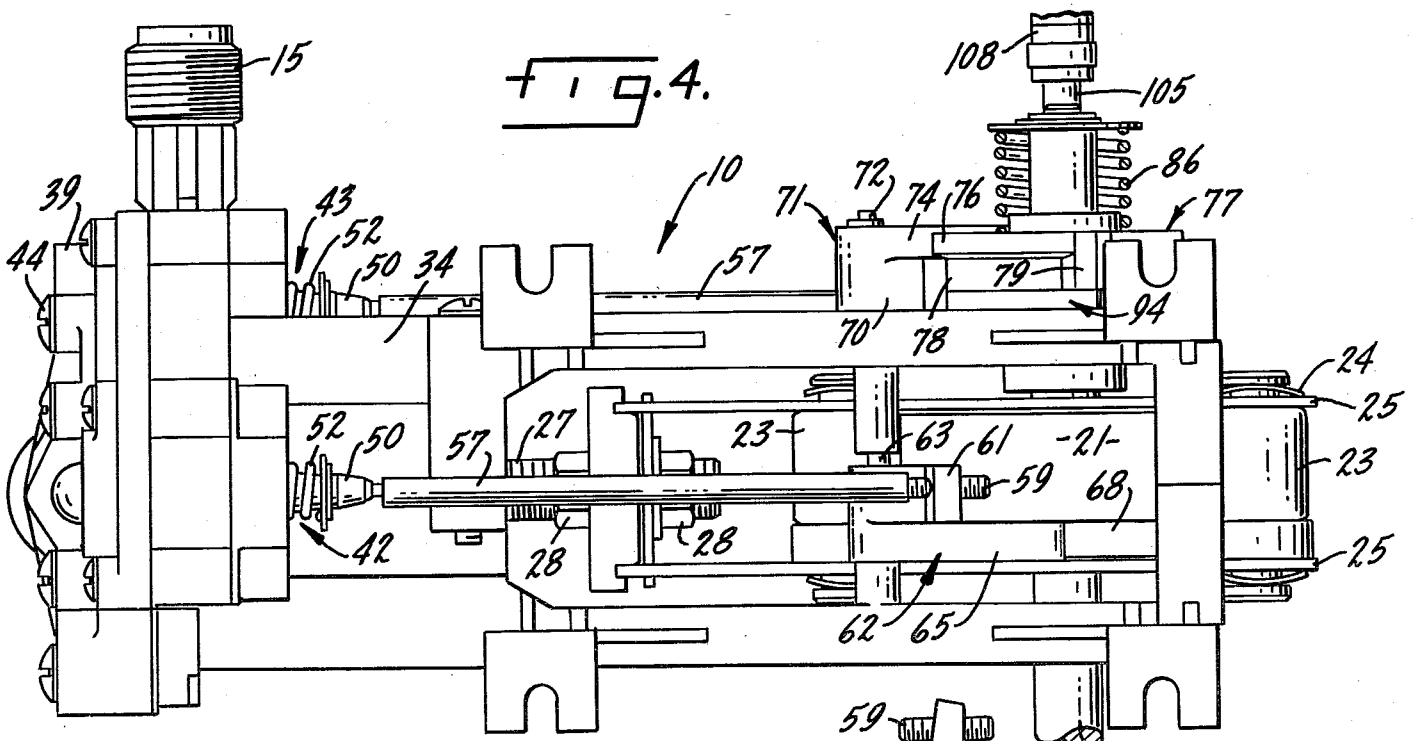
FIG. 4 is a partially broken-away bottom view of the pump in FIG. 2.
Figure 6:
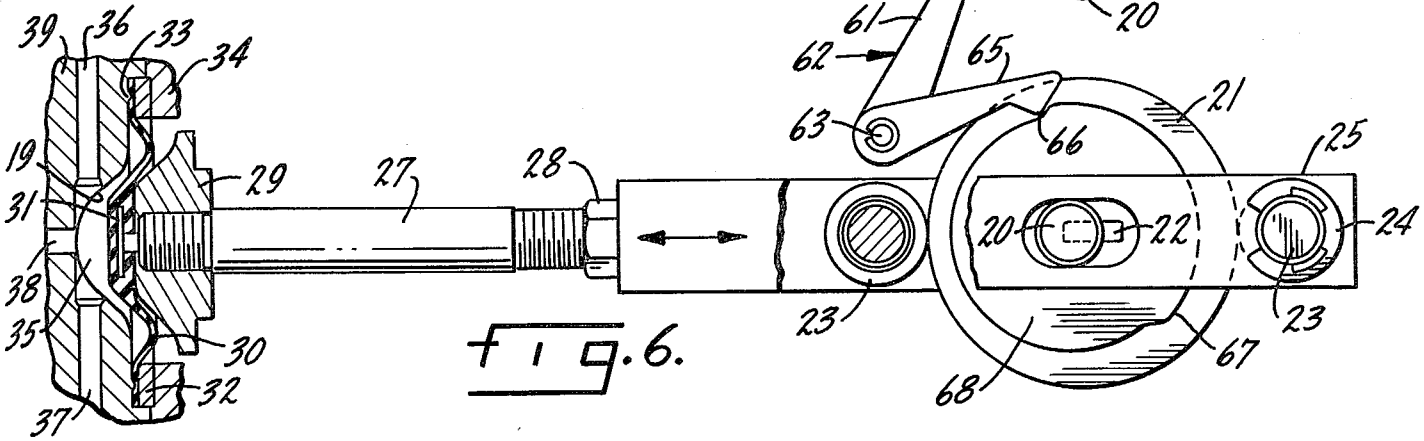
FIG. 6 is a partially cross-sectional schematic side view of the drive mechanism for the pump shown herein.
Figure 5:
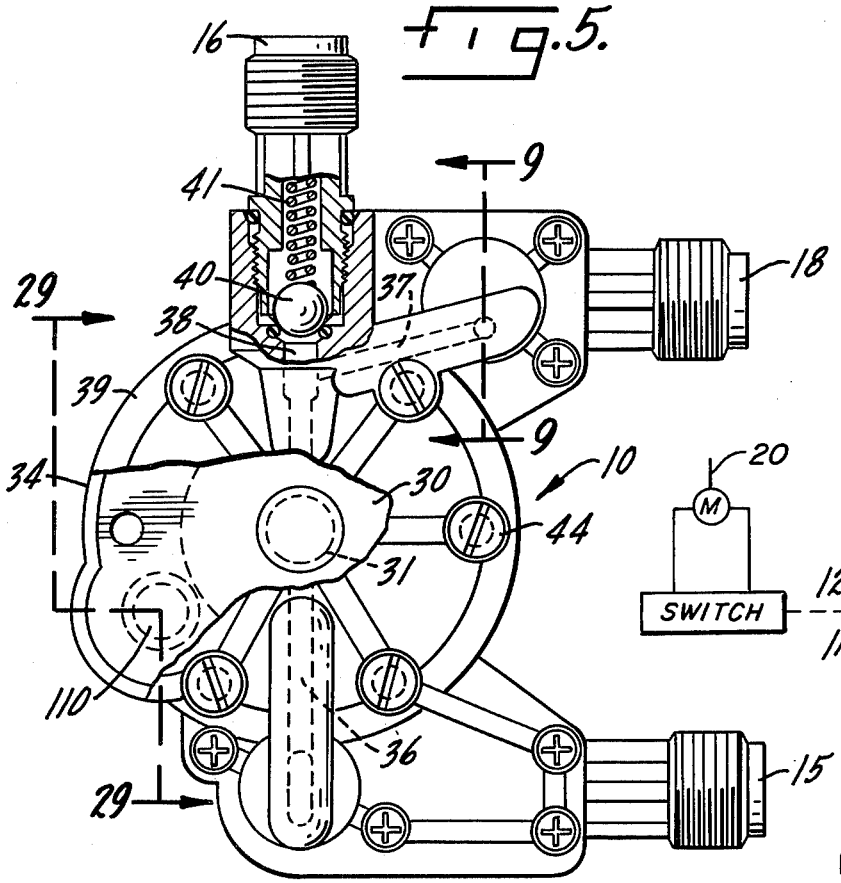
FIG. 5 is a partially cross-sectional end view of the pump in FIG. 2.
Figure 30:
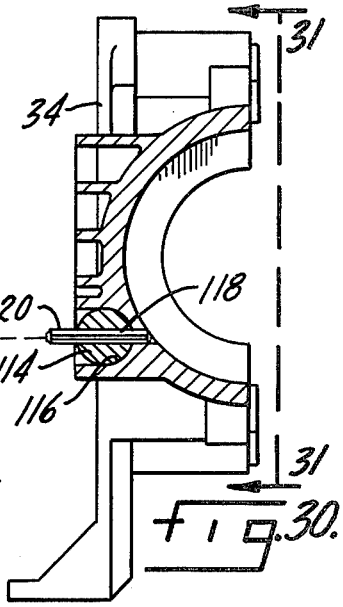
FIG. 30 is a cross-sectional view taken along the line 30—30 in FIG. 29.
Figure 29:
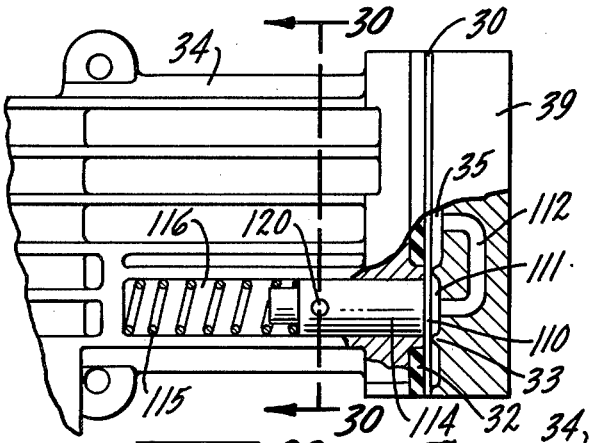
FIG. 29 is an enlarged, partially cross-sectional side view taken generally along the line 29—29 in FIG. 5.
Figure 31:
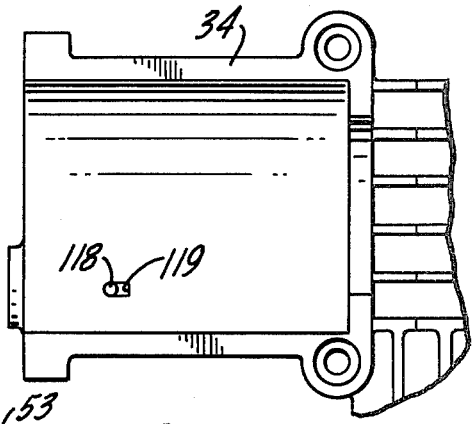
FIG. 31 is a side view taken along the line 31—31 in FIG. 30.

An adjustable flow control cam 94 is loosely mounted for rotation on shaft 20 so that its movement is independent of the shaft. Cam 94 is coaxial with cam 77, and has a second pair of projections 95 and 96 shaped like circular arcs extending from its flat surface 97. Ramps 98 merge each end of each of the projections 95 and 96 into flat surface 97 of cam 94. Projections 95 and 96 are located with respect to shaft 20 as if they were the mirror images of projections 89 and 90. Projection 89 is substantially idential to projection 95 and projection 90 is substantially identical to projection 96, so cams 77 and 94 can nest within each other (as shown in FIG. 7). When the cams are thus nested, projections 89 and 90 contact flat surface 97 and projections 95 and 96 contact flat surface 91. When projections 89 and 90 are rotated into contact with projections 95 and 96, projections 95 and 96 move cam 77 along shaft 20 so as to compress spring 86 (as shown in FIG. 8). Spring 86 returns cam 77 when the projections move out of contact.

Cam 94 has gear teeth 100 around over half of its circumference, and teeth 100 mate with the teeth 101 on an adjusting gear 102. Gear 102 is fixed by a pin 104 to a rotatable shaft 105 journaled in holes in housing 34. A spring 106 coiled around shaft 105 urges the surface 107 of gear 102 into frictional contact with the side of housing 34 to provide resistance against turning of gear 102. A knob 108 affixed to shaft 105 permits rotation of gear 102 and cam 94 to different positions that will control the length of time during the pump discharge stroke that return valve 43 is open and thereby control the amount of liquid metered by pump 10.

The manner in which cam 94 controls the output of pump 10 and also automatically degasses the pump will be explained with reference to FIGS. 17–28. FIGS. 19, 22, 25 and 28 show the position of flow control cam 94 that would result in the amount of liquid metered by pump 10 being around half of its capacity; the position of projection 89 as it moves against cam 94 is shown in phantom.

FIGS. 17–19 show the position of liquid return cam 77 and arm 74 of lever 71 as drive cam 21 starts to push diaphragm 30 into chamber 35 at the beginning of the pressure or discharge stroke. Valve 42 is closed and projections 89 and 90 are in contact with flat surface 97 of cam 94. Lug 75 has moved up on to cam surface 76, and this has moved actuating rod 57 so as to compress spring 52 and open valve 43. Any gas trapped in chamber 35 or the passages connected to the chamber is free to escape through return port 18, which is essentially at atmospheric pressure. No liquid can be pumped through discharge port 16 because check valve 40 creates a backpressure in passage 38; liquid can only be expelled through return port 18 while valve 43 is open.

FIGS. 20–22 show the position of cam 77 about one-quarter of the way through the pressure stroke. Ramps 92 are about to engage ramps 96 and projections 89 and 90 are still moving along the flat surface 97 of cam 94, so lobe 75 is still riding on surface 76 of cam 77. The result is that valve 43 is still open and liquid can only flow out through port 18. Thus, part of the discharge stroke has passed without any liquid being pumped through port 16.

FIGS. 23–25 show the position of cam 77 about half way through the discharge stroke. Projections 89 and 90 have moved into contact with projections 95 and 96 on cam 94. This has shifted cam 77 along shaft 20 away from the position indicated in phantom in FIGS. 23 and 26. This moves lug 75 into gulley 78 and out of contact with surface 76; this permits spring 52 to push valve 43 into its closed position. Continued movement of diaphragm 30 into chamber 35 during the remainder of the discharge stroke will force the valve members 48 more tightly against their seats so pressure will build up until the force of spring 41 and any backpressure at port 16 are overcome. This will open check valve 40 and permit liquid to be pumped through port 16.

FIGS. 26–28 show the position of cam 77 at the end of the discharge stroke. Projections 89 and 90 are still in contact with projections 95 and 96 on cam 94, so cam 77 is still shifted along shaft 20 and is holding spring 86 in compression. But lobe 79 extends all the way across the edge of cam 77, so lug 75 has moved up on to lobe 79 and is in the same position it would be if it were on surface 76. This has pivoted lever 71 so as to cause valve 43 to open, which will cause valve 40 to close. This permits gas that has been compressed during the discharge stroke to be expelled through return port 18. Continued rotation of shaft 20 will move diaphragm 30 in the opposite direction and will cause lug 75 to ride over lobe 79 into contact with surface 82 on cam 77; this will permit spring 52 to close valve 43 during the intake or suction stroke of the pump. When projections 89 and 90 move past projections 95 and 96, spring 86 will slide cam 77 back along shaft 20 until projections 89 and 90 contact surface 97 and projections 95 and 96 contact surface 91, and lug 75 will be returned to surface 76. Cam 68 opens intake valve 42 during the suction stroke.

Rotation of knob 108 will rotate gear 102 and this will rotate cam 94 to a different position that will change the output of pump 10. For example, rotation of cam 94 in the clockwise direction (as seen in FIG. 19) will move projections 95 and 96 further away from the ramps 92 at the leading edge of projections 89 and 90. The result will be that cam 77 will have to rotate for a longer time before projections 89 and 90 contact projections 95 and 96, and therefore lobe 75 will ride on surface 76 for a longer portion of the discharge stroke. Since return valve 43 is open when lobe 75 is on surface 76, liquid will be recycled through port 18 for a longer portion of the discharge stroke and the output of pump 10 will be reduced.

The maximum reduction in the output of pump 10 will occur when cam 94 is rotated about ninety degrees from the position shown in FIG. 19, in which case projections 89 and 90 will not contact projections 95 and 96 until after the discharge stroke is over and the suction stroke has begun. This will cause lobe 75 to ride on surface 76 for the entire discharge stroke, which will hold valve 43 open and prevent any liquid from leaving port 16. As the suction stroke begins, lug 75 moves down off of surface 76 on to surface 82; this permits spring 52 to close valve 43.

Similarly, rotation of knob 108 so as to rotate cam 94 in the counterclockwise direction (as seen in FIG. 19) will move projections 95 and 96 closer to the ramps 92 at the leading edges of projections 89 and 90. The result will be that cam 77 will rotate for a shorter time before projections 89 and 90 contact projections 95 and 96, and therefore lug 75 will ride on surface 76 for a shorter portion of the discharge stroke. Thus intake valve 43 will be open for less of the discharge stroke and the output of pump 10 will be increased.

The maximum output of pump 10 will occur when cam 94 is rotated about ninety degrees counterclockwise from the position shown in FIG. 19, in which case projections 89 and 90 will contact projections 95 and 96 during the entire discharge stroke. This will shift cam 77 along shaft 20 during the entire discharge stroke and will cause lug 75 to move along entire length of the bottom of gulley 78. Thus, valve 43 will be open only at the beginning and the end of the discharge stroke when lug 75 rides over lobes 79 and 80 so as to degas the pump. Since lobes 79 and 80 extend all the way across the edge of cam 77, they will always open valve 43 at the beginning and the end of the discharge stroke, regardless of the position to which cam 77 has been shifted along shaft 20.

It is also possible to position lobe 79 in other locations on cam 77. For example, lobe 79 can be located so that return valve 43 is opened briefly just after or as the suction stroke begins. This relieves hydraulic and gas pressure in pump 10, and it increases the life of valve 43 by not requiring that valve 43 open against the full pressure developed in pump chamber 35.

A relatively small pump 10 as described herein is capable of developing high pressure. For example, such a pump powered by a one-fiftieth of a horsepower electric motor having a diaphragm 35 with an effective pumping area of 1.7 square inches making strokes 0.2 inches in length at a rate of thirty-five strokes per minute can develop output pressures in passage 38 of over 200 pounds per square inch. The maximum volume of liquid discharged by such a pump would be about thirty-five gallons per day. Since it is possible for blockage to occur downstream from discharge port 16, pump 10 has means for protecting it from excess pressure. A small circular portion 110 (e.g., one-eighth of a square inch) on diaphragm 30 faces a cavity 111 in head 39 which communicates with chamber 35 through a passage 112. Thus the pressure in cavity 111 is the same as the discharge pressure in pump chamber 35. One end of a cylindrical piston 114 contacts portion 110 directly opposite to cavity 111, and the other end of piston 114 bears against a coil spring 115. Piston 114 and spring 115 are slidable in a circular cavity 116 in housing 34. A pin 118 passing through piston 114 has one end journaled in a slot 119 permitting movement of pin 118 with the piston. The other end 20 of pin 118 extends from housing 34 and may be connected to a conventional switch (not shown) capable of shutting off the electric motor powering pump 10. The area of piston 114 and the strength of spring 115 are related such that when the pressure in cavity 111 reaches some predetermined safe limit (e.g., 205 p.s.i.), portion 110 of the diaphragm will move piston 114 against spring 115. This will move the end 120 of pin 118 and actuate the switch so as to shut off the electric motor powering pump 10. This will prevent the pressure in pump 10 from rising so high that it would damage diaphragm 30 or other structural members of the pump.

It has thus been shown that by the practice of this invention, a compact liquid metering pump 10 is protected from malfunctioning by a mechanism that is also used to control its output. The mechanism employs a pair of poppet valves 42 and 43 that are opened by power-driven cams 68 and 77 which pivot levers 62 and 71. This power-driven movement compresses springs 52 which move valve members 48 into sealing engagement with valve seats 45 when the power driving the cams is removed from lugs 66 and 75 on the levers. Springs 52 are at least about twenty times as strong as the springs that can be used to close lightly biased check valves in metering pumps, and spring 41 of outlet check valve 40 can be from ten to twenty times as strong as the spring used in such pumps. Thus, springs 41 and 52 are strong enough to force valve members 40 and 48 to seal tightly even through impurities or precipitates from the liquid being metered are deposited on them or on their seats. But springs this strong could not be used unless valves 42 and 43 were opened by power from an external power source. The same power-driven mechanism including cam 77 and valve 43 is used to regulate the amount of liquid metered by pump 10 by controlling the length of time that liquid return conduit 37 is open. Small changes in pump output can thus be accurately controlled. Such control is achieved by positioning cam 94 so that it slides cam 77 along shaft 20 and thereby moves surface 76 out of contact with lug 75 on lever 71 during part of the discharge stroke of diaphragm 30. This lets spring 52 close valve 43, and thereby enables diaphragm 30 to pump liquid past check valve 40. Cam 77 has lobes 79 and 80 which automatically open valve 43 to degas or depressurize pump 10 at the beginning and end of every discharge stroke, or at the beginning of the discharge and suction strokes.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A pump for metering controllable quantities of liquid comprising:

A. a body having a pump chamber, a liquid inlet conduit and a liquid return conduit connecting said chamber to a source of said liquid, and a liquid discharge conduit connecting said chamber to an outlet for metered liquid:

B. a reciprocating member in said chamber which moves in one direction to create a suction for drawing liquid from said source through said inlet conduit into said chamber and moves in the opposite direction to create pressure for pumping such liquid out of said chamber through said return conduit and said discharge conduit;

C. a first reciprocating poppet valve which is power driven to open said inlet conduit when said member moves in said one direction and which is moved to close said inlet conduit when said member moves in said opposition direction;

D. a second reciprocating poppet valve which is power driven to open said return conduit when said member moves in said opposite direction, and which is moved to close said return conduit when said member moves in said one direction, said second poppet valve being connected to a pivoted lever having a cam follower lug; and E. means for controlling the output of said pump by controlling the length of time said second poppet valve opens said return conduit, comprising a rotating cam having an edge that pivots said lever and thereby opens said second poppet valve when said edge is in contact with said lug, the length of time said second poppet is open being controlled by means for moving said edge out of contact with said lug, comprising a projection on said rotating cam located in a plane perpendicular to said edge, and an adjustable cam for contacting said projection and moving said edge axially out of contact with said lug, said projection and said adjustable cam being shaped like circular arcs.

2. The invention defined in claim 1, wherein said first and second poppet valves are moved to close their respective conduits by springs.

3. The invention defined in claim 2 wherein said springs each close said valves with a force of at least about two pounds.

4. The invention defined in claim 1, further comprising a check valve in said discharge conduit that creates a pressure against which liquid from said chamber is discharged.

5. The invention defined in claim 4, wherein said check valve is closed by a spring having a force of at least about one pound.

6. The invention defined in claim 2, wherein said reciprocating member and said first poppet valve each are actuated by cams, and such cams are aligned coaxially on the same rotating shaft.

7. The invention defined in claim 6, wherein the cam that actuates said reciprocating member actuates a yoke connected to said reciprocating member.

8. The invention defined in claim 6, wherein each of the cams which actuates a poppet valve contacts a separate pivoted lever having an arm connected to its poppet valve.

9. The invention defined in claim 8, wherein each poppet valve is connected to its pivoted lever by coaxial shaft means, and said springs surround said shaft means and are compressed by the movement of said shaft means which opens said poppet valves.

10. The invention defined in claim 9, wherein the spring for each poppet valve is isolated from contact with the liquid being pumped.

11. The invention defined in claim 1, further comprising spaced lobes on said rotating cam which contact said lug so as to open said second poppet valve for predetermined time periods, whereby gas pressure in said chamber is relieved through said return conduit.

12. The invention defined in claim 1, wherein said reciprocating member comprises a flexible diaphragm defining a surface of said chamber.

13. The invention defined in claim 12, further comprising means isolating a portion of said diaphragm, a spring-biased piston axially aligned in a cavity directly opposite to said portion, said piston being movable against said spring whenever the pressure in said chamber exceeds a predetermined value, and means actuated by movement of said piston for terminating reciprocation of said diaphragm.

14. A pump for metering controllable quantities of liquid comprising:

A. a body having a pump chamber, a liquid inlet passage and a liquid return passage in said body connecting said chamber to a source of said liquid, and a liquid discharge passage in said body connecting said chamber to an outlet for said liquid, a check valve in said discharge passage that creates a pressure against which liquid from said chamber is discharged;

B. a reciprocating flexible diaphragm defining a surface of said chamber, said diaphragm moving in one direction to create a suction for drawing liquid through said inlet passage into said chamber and moving in the opposite direction to create pressure for pumping such liquid out of said chamber through said return passage and said discharge passage;

C. a first reciprocating poppet valve which is power driven to open said inlet passage when said diaphragm moves in said one direction and which is moved to close said inlet passage when ssaid diaphragm moves in said opposite direction, a second reciprocating poppet valve which is power driven to open said return passage when said diaphragm moves in said opposite direction, and which is moved to close said return passage when said member moves in said one direction, said diaphragm and said first and second poppet valves each being actuated by a cam, and such cams being aligned coaxially on the same rotating shaft, each of the cams which actuates a poppet valve contacting a separate pivoted lever having an arm connected to its poppet valve by a coaxial shaft, a return spring surrounding each shaft and being compressed by the movement of said shaft which opens said poppet valves, the return spring for each poppet valve being located out of said passages and being isolated from contact with the liquid being pumped and having a valve closing force of at least about two pounds; and D. means for controlling the output of said pump by controlling the length of time said second poppet valve opens said return passage comprising a cam follower lug on the pivoted lever connected to said second poppet valve, said cam which actuates said second poppet valve being a rotating cam having an edge that pivots said lever and thereby opens said second poppet valve when said edge is in contact with said lug, an arcuate projection on said rotating cam located in a plane perpendicular to said edge, an adjustable arcuate cam for contacting said projection and moving said edge axially out of contact with said lug, and spaced lobes on said rotating cam which contact said lug so as to open said second poppet valve for predetermined time periods before and after said diaphragm discharges liquid from said chamber, whereby gas pressure in said chamber is relieved through said return passage.

15. The invention defined in claim 14, further comprising means isolating a portion of said diaphragm, a spring-biased piston axially aligned in a cavity directly opposite to said portion of said diaphragm, said piston being movable against said spring whenever the pressure in said chamber exceeds a predetermined value, and means actuated by movement of said piston for terminating reciprocation of said diaphragm.

16. A pump for metering controllable quantities of liquid comprising:

A. a body having a pump chamber, a liquid inlet conduit and a liquid return conduit connecting said chamber to a source of liquid, and a liquid discharge conduit connecting said chamber to an outlet for metered liquid;

B. means for drawing liquid from said source through said inlet conduit into said chamber and for pumping liquid out of said chamber through said return conduit and said discharge conduit;

C. means for controlling liquid flow through said inlet conduit; and

D. means for controlling the quantity of liquid discharged by said pump by controlling liquid flow through said return conduit comprising:

1. a reciprocating poppet valve movable to open and close said return conduit,
2. a pivoted lever having a cam follower lug at one end, said lever being connected to said poppet valve,
3. a rotating cam synchronized with said means for pumping liquid out of said chamber, said rotating cam having an edge that pivots said lever and thereby opens said poppet valve when said edge is in contact with said lug, and
4. means for controlling the opening and closing of said poppet valve by moving said edge out of contact with said lug, comprising a projection on said rotating cam located in a plane perpendicular to said edge, an adjustable cam for contacting said projection and moving said edge axially out of contact with said lug, said adjustable cam having gear teeth on its peripheral edge, and its radial position being controlled by an adjusting knob connected to a gear having teeth mating with said teeth on its edge.

17. The invention defined in claim 16, further comprising a check valve in said discharge conduit that creates a pressure against which liquid from said chamber is discharged.

18. The invention defined in claim 16, wherein said rotating cam and said adjustable cam are in coaxial abutting alignment.

19. The invention defined in claim 16 further comprising spaced lobes on said rotating cam which contact said lug so as to open said poppet valve for predetermined time periods, whereby gas in said chamber is expelled through said return conduit.

20. A pump for metering controllable quantities of liquid comprising:

A. a body having a pump chamber, a liquid inlet conduit and a liquid return conduit connecting said chamber to a source of liquid, and a liquid discharge conduit connecting said chamber to an outlet for metered liquid, a check valve in said discharge conduit that creates a pressure against which liquid from said chamber is discharged;

B. means for drawing liquid from said source through said inlet conduit into said chamber and for pumping liquid out of said chamber through said return conduit and said discharge conduit;

C. means for controlling liquid flow through said inlet conduit; and

D. means for controlling the quantity of liquid discharged by said pump by controlling liquid flow through said return conduit comprising:

1. a reciprocating poppet valve movable to open and close said return conduit,
2. a pivoted lever having a cam follower lug at one end, said lever being attached to said poppet valve,
3. a rotating cam synchronized with said means for pumping liquid out of said chamber, said rotating cam having an edge that pivots said lever and thereby opens said poppet valve when said edge is in contact with said lug,
4. an arcuate projection on said rotating cam located in a plane perpendicular to said edge, and an adjustable arcuate cam for contacting said projection and moving said edge axially out of contact with said lug, said rotating cam and said adjustable cam being in coaxial abutting alignment, and
5. said adjustable cam having gear teeth on its peripheral edge, and its radial position being controlled by an adjusting knob connected to a gear having teeth mating with said teeth on its edge.

21. The invention defined in claim 20, further comprising spaced lobes on said rotating cam which contact said lug so as to open said poppet valve for predetermined time periods at the beginning and the termination of the pumping action of said means for pumping liquid, whereby gas in said chamber is expelled through said return conduit.

22. A pump for metering controllable quantities of liquid comprising:

A. a body having a pump chamber, a liquid inlet conduit and a liquid return conduit connecting said chamber to a source of liquid, and a liquid discharge conduit connecting said chamber to an outlet for metered liquid;

B. means for drawing liquid from said source through said inlet conduit into said chamber and for pumping liquid out of said chamber through said return conduit and said discharge conduit;

C. means for controlling liquid flow through said inlet conduit; and

D. means for controlling the quantity of liquid discharged by said pump by controlling liquid flow through said return conduit comprising:

1. a reciprocating poppet valve movable to open and close said return conduit,
2. a pivoted lever having a cam follower lug at one end, said lever being connected to said popper valve,
3. a rotating cam synchronized with said means for pumping liquid out of said chamber, said rotating cam having an edge that pivots said lever and thereby opens said poppet valve when said edge is in contact with said lug, and
4. means for controlling the opening and closing of said poppet valve by moving said edge out of contact with said lug, comprising a projection on said rotating cam located in a plane perpendicular to said edge, an adjustable cam for contacting said projection and moving said edge axially out of contact with said lug, said adjustable cam being rotatable and having a projection extending in the direction said edge is axially movable, and said projections on said cams being shaped like circular arcs.

* * * * *